US008696086B2

(12) United States Patent
Nakazawa

(10) Patent No.: US 8,696,086 B2
(45) Date of Patent: Apr. 15, 2014

(54) INK-JET PRINTER AND METHOD FOR REPLACING FILLING LIQUID IN INK-JET HEAD

(75) Inventor: Fumio Nakazawa, Okazaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 180 days.

(21) Appl. No.: 13/239,935

(22) Filed: Sep. 22, 2011

(65) Prior Publication Data

US 2012/0075364 A1 Mar. 29, 2012

(30) Foreign Application Priority Data

Sep. 28, 2010 (JP) ..... 2010-217427

(51) Int. Cl.
*B41J 2/015* (2006.01)

(52) U.S. Cl.
USPC ..... 347/21; 347/7; 347/35

(58) Field of Classification Search
USPC ..... 347/7, 20–23, 28, 35–37
See application file for complete search history.

(56) References Cited

U.S. PATENT DOCUMENTS 6,193,355 B1 * 2/2001 Nakamura ..... 347/30
6,386,677 B1 5/2002 Imai et al.
7,784,896 B2 * 8/2010 Usuda et al. ..... 347/19
2002/0097292 A1 7/2002 Saijo et al.
2003/0146945 A1 * 8/2003 Inui et al. ..... 347/7
2006/0164448 A1 * 7/2006 Sugiyama et al. ..... 347/5
2006/0268028 A1 * 11/2006 Saruta et al. ..... 347/9
2008/0239029 A1 * 10/2008 Hayashi et al. ..... 347/85
2010/0245436 A1 9/2010 Nishida

FOREIGN PATENT DOCUMENTS

JP 11078068 3/1999
JP 2002-283590 10/2002
JP 2010-228288 10/2010

* cited by examiner

*Primary Examiner* — Julian Huffman
*Assistant Examiner* — Sharon A Polk
(74) *Attorney, Agent, or Firm* — Frommer Lawrence & Haug LLP

(57) ABSTRACT

There is provided an ink-jet printer including: an ink supply source; an ink-jet head in which a plurality of nozzle groups corresponding to a plurality of color inks are formed; a maintenance mechanism; a controller which controls the ink-jet head and the maintenance mechanism; and a filling liquid filled in the ink-jet head in a state before the ink-jet printer is used for the first time, wherein, in the state before the ink-jet printer is used for the first time, the controller controls the maintenance mechanism and the ink-jet head to perform an initial discharge operation; and an amount of a liquid discharged from the ink-jet head during the initial discharge operation is adjusted based on a color difference between one of the plurality of color inks and a replaced-ink.

10 Claims, 3 Drawing Sheets

INK-JET PRINTER AND METHOD FOR REPLACING FILLING LIQUID IN INK-JET HEAD

CROSS REFERENCE TO RELATED APPLICATION

The present application claims priority from Japanese Patent Application No. 2010-217427, filed on Sep. 28, 2010, the disclosure of which is incorporated herein by reference in its entirety.

BACKGROUND OF THE INVENTION

1. Field of the Invention

The present invention relates an ink-jet printer in which an ink-jet head is charged with a filling liquid different from an ink in a state before the ink-jet printer is used for the first time, and a method for replacing the filling liquid in the ink-jet head with the ink.

2. Description of the Related Art in a certain ink-jet recording apparatus, when ink cartridges are installed, a purge (initial purge) is performed to discharge a preservative solution (a liquid for preservation) in the recording head from nozzles, and then a flushing (initial flushing) is performed to jet inks from the nozzles. By doing so, bubbles etc. remained in the nozzles are completely discharged. Here, the purge is performed by driving a suction pump connected with a suction cap in a state that a nozzle surface of the recording head is covered with the suction cap.

Further, in this ink-jet recording apparatus, when the ink-jet recording apparatus is shipped from a factory, the preservative solution (filling liquid) is charged in the recording head (ink-jet head) in order to avoid drying. In other words, the filling liquid, which is different from the ink used in printing, is charged in the ink-jet head before printing is performed for the first time (before the ink-jet recording apparatus is used for the first time). Therefore, when the ink cartridges are installed at the time of the first use of the ink-jet recording apparatus, the preservative solution in the ink-jet head is discharged by the purge described above and is replaced by four color inks supplied from the ink cartridges. Subsequently, the flushing is performed to discharge the preservative solution, which was unable to be discharged by the initial purge, together with bubbles etc. remained in the nozzles.

It has been known that a liquid, which is different from an ink for recording, is used as the filling liquid charged in the recording head. In particular, it has been known that an ink for physical distribution (an ink which is charged in the recording head during the shipping, a shipping-ink) is used, the ink for physical distribution being a liquid in which components easy to adhere and water ratio are reduced from the ink for recording and components of solvent are increased.

SUMMARY OF THE INVENTION

In order to ensure printing quality, it is necessary that the ink for physical distribution, which was unable to be discharged by the initial purge, be satisfactorily discharged during the initial flushing to considerably reduce a color change of ink, which is caused when the ink is mixed with the filling liquid. For this reason, the ink is jetted excessively in the initial flushing. As a result, there has been the problem that ink consumption in the initial flushing is increased.

An object of the present invention is to provide an ink-jet printer, which is capable of restraining ink consumption as much as possible in an initial flushing performed after replacing a filling liquid in an ink-jet head with an ink, and a method for replacing the filling liquid in the ink-jet head.

According to a first aspect of the present teaching, there is provided an ink-jet printer jetting a plurality of color inks, including:

an ink supply source which supplies the plurality of color inks;

an ink-jet head which is connected to the ink supply source and in which a plurality of nozzles are formed, the plurality of nozzles forming a plurality of nozzle groups from which inks having different colors from each other of the plurality of color inks are jetted respectively;

a purge mechanism which discharges a liquid in the ink-jet head from the plurality of nozzles;

a controller which controls the ink-jet head and the purge mechanism; and a filling liquid which is charged in the ink-jet head in a state before the ink-jet printer is used for the first time, is different from the plurality of color inks, and contains a color material of a certain color, wherein, in the state before the ink-jet printer is used for the first time, the controller controls the purge mechanism and the ink-jet head to make the purge mechanism and the ink-jet head perform an initial discharge operation including an initial purge and an initial flushing; and an amount of a discharge ink discharged from the ink-jet head during the initial discharge operation is adjusted based on a color difference between each of the plurality of color inks supplied from the ink supply source to the ink-jet head and a replaced-ink formed by replacing a part of the filling liquid with each of the plurality of color inks supplied into the ink-jet head.

According to a second aspect of the present teaching, there is provided a method for replacing a filling liquid in an ink-jet head, which is charged with the filling liquid, by a plurality of color inks, including the steps of:

performing an initial purge in which the filling liquid in the ink-jet head is replaced by each of the plurality of color inks supplied from an ink supply source by discharging a discharge ink which includes the filling liquid and the plurality of color inks from the ink-jet head which is connected to the ink supply source supplying the plurality of color inks, in which a plurality of nozzles are formed, the plurality of nozzles forming a plurality of nozzle groups from which the inks having different colors from each other of the plurality of color inks are jetted respectively, and in which the filling liquid which is different from the plurality of color inks and contains a color material of a certain color is charged in a state before an ink-jet printer is used for the first time; and performing an initial flushing in which the discharge ink including the filling liquid and the plurality of color inks is discharged from the plurality of nozzles after performing the initial purge, wherein, during at least one of the initial purge and initial flushing steps, an amount of the discharge ink discharged from the ink-jet head is adjusted based on a color difference between each of the plurality color inks supplied from the ink supply source into the ink-jet head and a replaced-ink formed by replacing a part of the filling liquid with each of the plurality of color inks supplied into the ink-jet head.

According to the present teachings described above, during the initial flushing and/or the initial purge, it is possible to jet the inks from the plurality of nozzles, from which the ink having different colors from each other are jetted, according to the respective color differences between the inks supplied from the ink supply source and the replaced-inks formed by replacing the filling liquid. Therefore, the inks are not jetted excessively during the initial flushing and/or the initial purge, thereby being capable of suppressing the ink consumption during the initial flushing and/or the initial purge.

DRAWINGS

DESCRIPTION OF THE PREFERRED EMBODIMENTS

Hereinbelow, explanations will be made with respect to a preferred embodiment of the present teaching.

Figure 1:
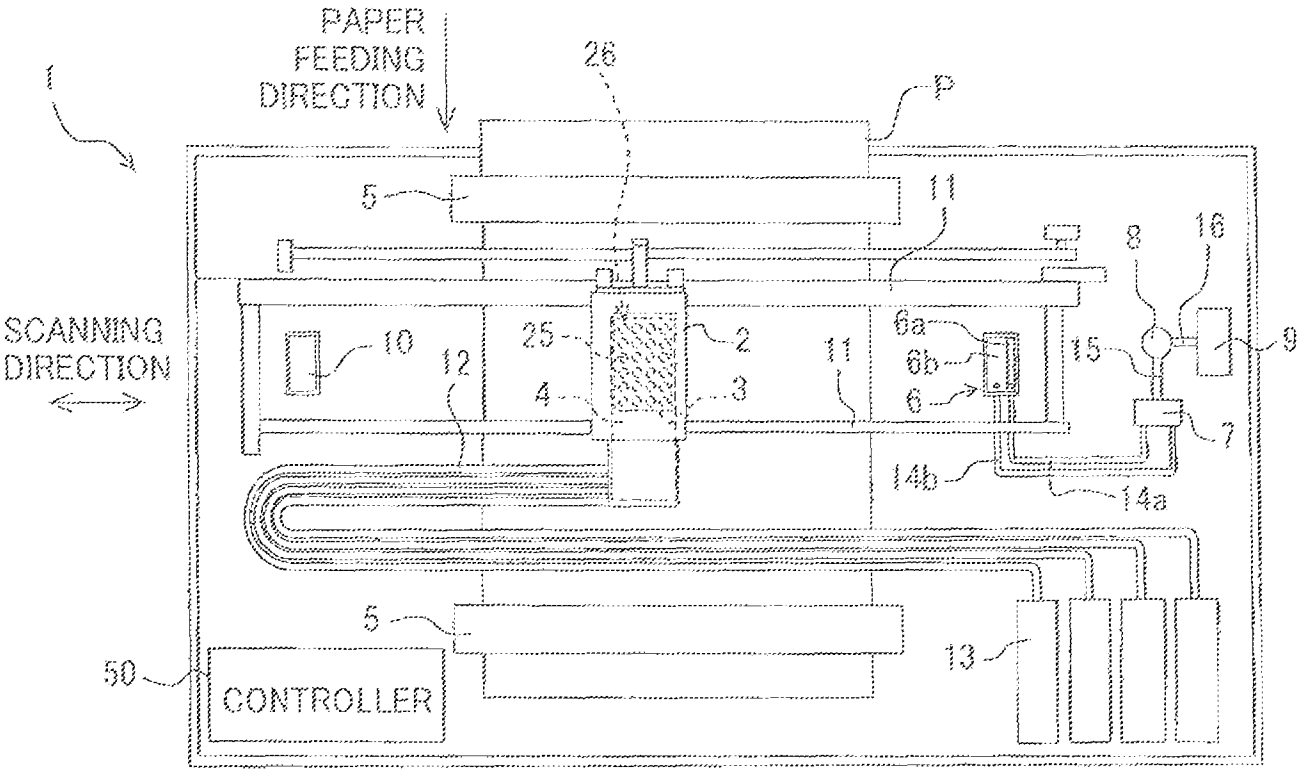
FIG. 1 is a schematic configuration diagram of a printer in accordance with an embodiment of the present invention.

A printer 1 according to this embodiment is an ink-jet printer. As shown in FIG. 1 the printer 1 includes a carriage 2, an ink-jet head 3, a sub tank 4, a paper transport roller 5, a suction cap 6, a switching device 7, a suction pump 8, a waste tank 9, a flushing foam 10, etc. A controller 50 controls an operation of the printer 1.

The carriage 2 reciprocatively moves in a scanning direction along two guide rails 11 extending in the scanning direction (left-right direction in FIG. 1). The ink-jet head 3 is arranged on the carriage 2, inks are jetted from a plurality of nozzles 25 formed on a lower sin-face of the ink-jet head 3. Here, four nozzles arrays 26 are arranged in the scanning direction on the lower surface of the ink-jet head 3. The nozzles arrays 26 include the plurality of nozzles 25 aligned in a paper feeding direction (upward-downward direction in FIG. 1) perpendicular to the scanning direction. The inks, the colors of which are different from each other according to the nozzle arrays 26, are jetted from the plurality of nozzles 25 constructing the four nozzles arrays 26. In this embodiment, the inks of black, yellow, cyan, and magenta are jetted from the plurality of nozzles 25 in order of the nozzle arrays 26 from the right side of FIG. 1. Note that, in this embodiment, the nozzle 25 for jetting the yellow ink corresponds to a yellow nozzle according to the present teaching, the nozzle 25 for jetting the magenta ink corresponds to a magenta nozzle according to the present teaching, and the nozzle 25 for jetting the cyan ink corresponds to a cyan nozzle according to the present teaching, respectively.

Further, of the four color inks jetted from the ink-jet head 3, the black ink is a pigment ink which contains a pigment as a color material, and color inks (yellow, cyan, magenta) are dye inks which contain dyes as the color material.

The sub tank 4 is arranged on the carriage 2. The interior of the sub tank 4 is partitioned into four small ink chambers, and each of the four color inks described above is supplied from one of the four small ink chambers to the ink-jet head 3. Further, the sub tank 4 is connected, via four ink tubes 12, with four ink cartridges 13 detachable with respect to the printer 1. In the four ink cartridges 13, the inks of black, yellow, cyan, and magenta are contained in order of the ink cartridges 13 from the right side of FIG. 1. Each of the inks contained in the ink cartridges 13 is supplied to the sub tank 4 via each of the ink tubes 12, and then is supplied from the sub tank 4 to the ink jet head 3. The paper transport roller 5 transports a recording paper P in the paper feeding direction.

In the printer 1, the inks are jetted from the ink-jet head 3, which reciprocatively moves in the scanning direction along with the carriage 2, onto the recording paper P transported by the paper transport roller 5 in the paper feeding direction. In this way, printing is performed on the recording paper P.

The suction cap 6 is arranged at the position to be opposed to the ink-jet head 3 in a state that the carriage 2 is moved to the most rightward position as viewed in FIG. 1. The suction cap 6 includes a cap section **6*a* which is opposed to the nozzles 25 constructing the nozzle array 26 disposed on the rightmost side in FIG. 1 and jetting the black ink, and a cap section 6*b* which is opposed to the nozzles 25 constructing the remaining three nozzle arrays and jetting the color inks. The suction cap 6 can move in the up and down direction by a lifting mechanism 31 (see FIG. 2). When the suction cap 6 is moved upward in a state that the ink-jet head 3 is facing the suction cap 6, the nozzles 25 constructing the nozzle array 26 disposed on the rightmost side and jetting the black ink are covered with the cap section 6*a*, simultaneously with which the nozzles 25 constructing the remaining three nozzles arrays 26 and jetting color inks are covered with the cap section 6*b***.

The two cap sections **6*a*, 6*b* are connected to the switching device 7 via tubes 14*a*, 14*b*, respectively. The switching device 7 is connected to the suction pump 8 via a tube 15. The switching device 7 selectively connects the suction pump 8 to one of the tubes 14*a*, 14*b*. The suction pump 8 may be, for example, a tube pump. The suction pump 8 is arranged on the side opposite to the switching device 7 and connected to the waste tank 9 via a tube 16**.

In the printer 1, as described above, it is possible to perform a so-called suction purge in which the suction pump 8 is driven in a state that the nozzles 25 are covered with the suction cap 6 to discharge any foreign matter etc. in the ink-jet head 3, together with the ink, from the nozzles 25. In this situation, when the suction pump 8 and the cap section **6*a* are connected each other by the switching device 7, the black ink is discharged from the ink-jet head 3. On the other hand, when the suction pump 8 and the cap section 6*b* are connected each other by the switching device 7, the color inks are discharged from the ink jot head 3**.

The flushing foam 10 is formed of a material, which is capable of absorbing the ink, such as a sponge. The flushing foam 10 is arranged at the position to be opposed to the ink-jet head 3 in a state that the carriage 2 is moved to the most leftward position as viewed in FIG. 1.

In the printer 1, the inks are jetted from the nozzles 25 in a state that the carriage 2 is moved to the position at which the ink-jet head 3 is opposed to the flushing foam 10, as described above. By doing so, it is possible to perform a so-called flushing, and thus it is possible to discharge any foreign matter in the ink-jet head 3.

Figure 2:
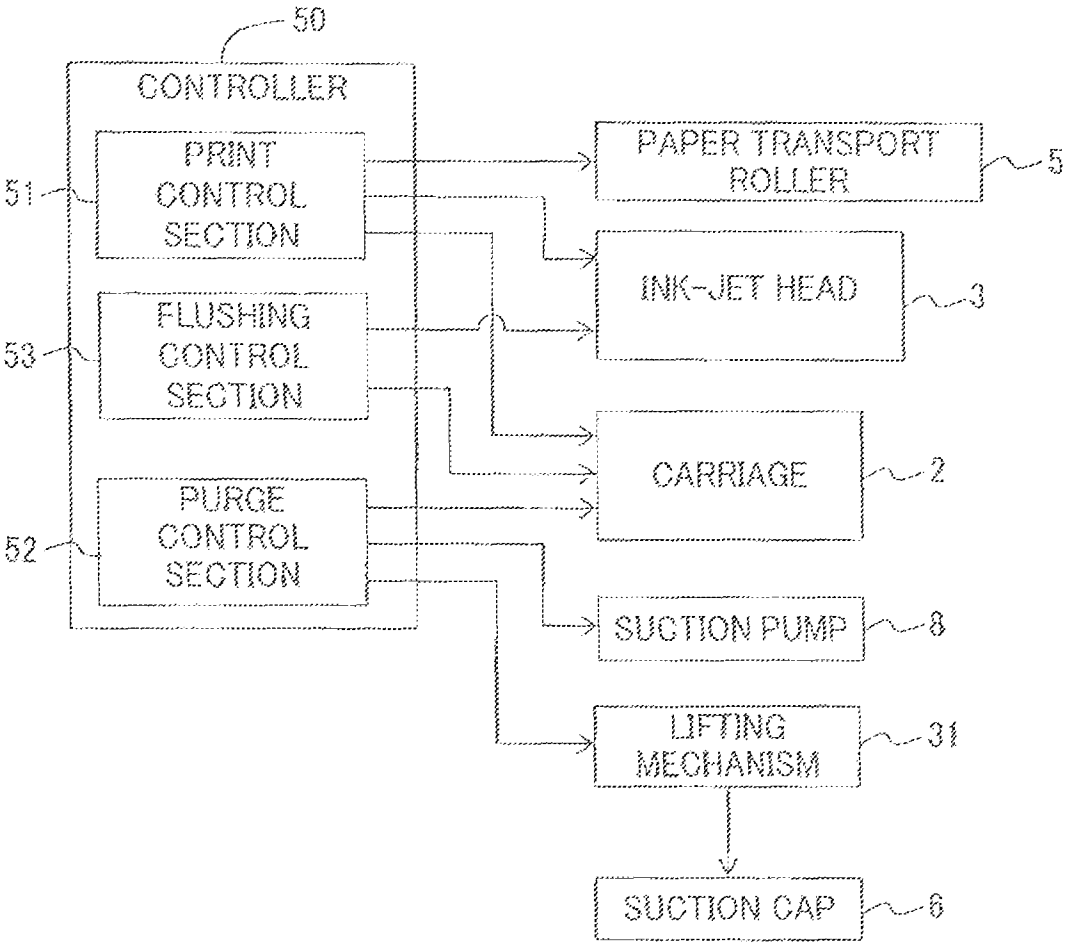
FIG. 2 is a functional block diagram of a controller of the printer of FIG. 1.

Next, an explanation will be made about a controller 50 which controls the operation of the printer 1. The controller 50 includes a Central Processing Unit (CPU), a Read Only Memory (ROM), a Random Access Memory (RAM), etc. The CPU, ROM, RAM, etc. operate cooperatively to serve as a print control section 51, a purge control section 52, a flushing control section 53, etc., as shown in FIG. 2.

The print control section 51 controls the carriage 2, the ink-jet head 3, the paper transport roller 5, etc., upon performing printing by the printer 1. The purge control section 52 controls the carriage 2, the lifting mechanism 31, the suction pump 8, etc., upon performing the suction purge described above. The flushing control section 53 controls the carriage 2, the ink-jet head 3, etc., upon performing the flushing described above.

Here, when the printer 1 is shipped from a factory (that is, in a state before printing is performed for the first time), a filling liquid (a charging liquid) different from the ink is charged into the ink-jet head 3 and the ink tubes 12. The filling liquid contains, as the color material, a dye which is the same as that of any of the three color inks. In this regard, however, the color material of the filling liquid has density lower than that of the color material of each of the inks. Thus, the color of the filling liquid is lighter than that of each of the inks. For example, the density of the color material with respect to each ink is about 0.2%, whereas the density of the color material with respect to the filling liquid is about 0.02%.

The filling liquid is not colorless and transparent, but contains the color material. Since the filling liquid contains the color material as described above, it is possible to use the filling liquid, for example, for checking nozzles at the time of producing of the printer 1. That is, it is possible to check as to whether the nozzles 25 are normal by jetting the filling liquid containing the color material onto the recording paper P etc. from the ink-jet head 3 and then checking the recording paper P having the filling liquid landed thereon. Here, it is also considered that a normal ink is charged into the ink-jet head 3 at the time of producing of the printer 1 to check the nozzles 25 as described above. However, unlike the nozzle check using the normal ink, the nozzle check using the filling liquid requires no step for replacing the ink in the ink-jet head 3 with the filling liquid after checking the nozzles 25, thereby simplifying the producing process of the printer 1.

When the printer 1 is shipped from a factory, and when the filling liquid other than the ink is charged into the ink-jet head 3 etc., it is necessary to replace the filling liquid charged in the ink-jet head 3 and the ink tubes 12 with the inks supplied from the ink cartridges 13 before the first use of the printer 1. Here, "the first use" denotes a state that a user uses the printer 1 to perform printing for the first time; and the printing is performed by using the normal ink other than the filling liquid. Hereinbelow, an explanation will be made about a process for replacing the filling liquid with the ink with reference to the flowchart of FIG. 3. In this embodiment, the flow shown in FIG. 3 is started when the printer 1 is powered on.

Figure 3:
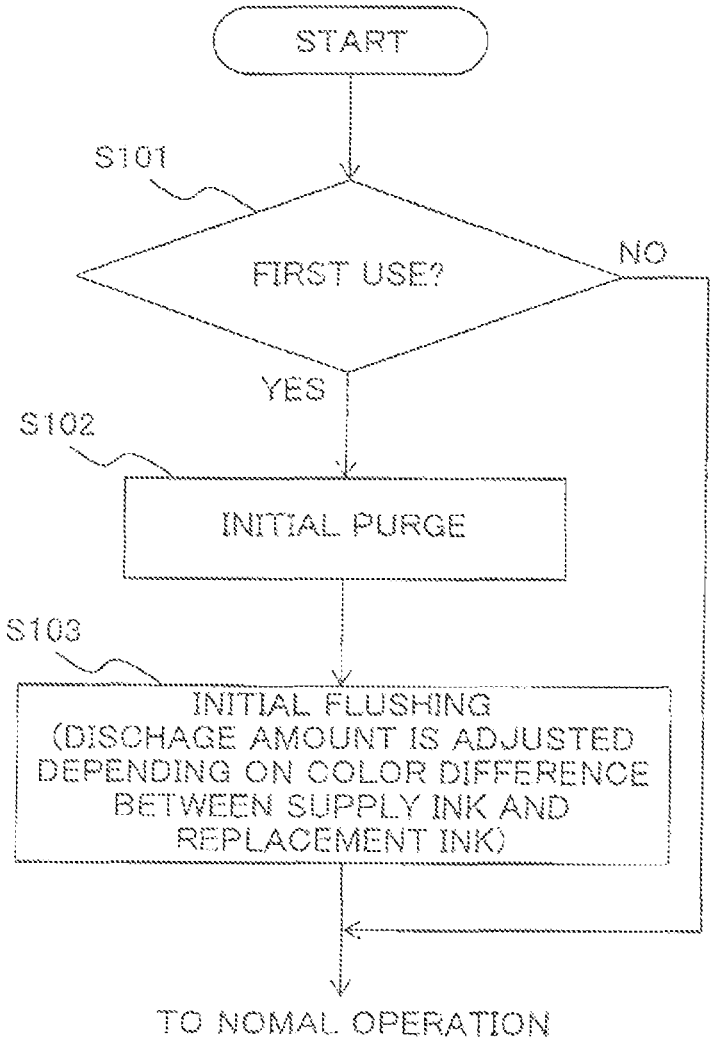
FIG. 3 is a flowchart for explaining an operation of the printer.

As shown in FIG. 3, when the printer 1 is powered on, it is judged as to whether the printer 1 is used for the first time (step 101, hereinafter referred to simply as S101 etc.). In a case that the printer 1 is used after the first use (S101: No), an initial purge and an initial flushing, as described later on, are not performed, and the process is directly switch to a normal operation for printing. Note that the control of the normal operation is the same as or equivalent to the conventional control, and the detailed explanation thereof is omitted.

In a case that the printer 1 is used for the first time (S101: Yes), the purge control section 52 controls the carriage 2, the suction pump 8, the lifting mechanism 31, etc. to carry out the suction purge (initial purge). As a result, the filling liquid in the ink-jet head 3 and the ink tubes 12 is discharged from the nozzles 25 (S102). When the filling liquid is discharged from the ink-jet head 3 and the ink tubes 12, the ink is flown from each of the ink cartridges 13 into the ink-jet head 3 and one of the ink tubes 12 in the same amount as that of the discharged filling liquid. Accordingly, the filling liquid in the ink-jet head 3 and the ink tubes 12 is replaced with the inks.

Subsequently, the flushing control section 53 controls the ink-jet head 3, the carriage 2, etc., to carry out the flushing (initial flushing). By doing so, the inks are jetted from the nozzles 25 (S103). After completion of the initial flushing, the process is switched to the normal operation. The initial purge and the initial flushing are referred to as an initial discharge operation.

In this embodiment, the filling liquid charged in the ink-jet head 3 is replaced with the ink supplied from each of the ink cartridges 13 by the initial purge. However, a part of the filling liquid, which was unable to be discharged by the initial purge, remains in the ink-jet head 3, immediately after the initial purge is completed. Because of this, in such a state, the filling liquid is mixed with the ink supplied from each of the ink cartridges 13, and the ink in which the ink supplied from each of the ink cartridges 13 is mixed with the filling liquid has a color different from that of the ink supplied from each of the ink cartridges 13. In this situation, when there is a great color difference between the ink supplied from each of the ink cartridges 13 (hereinafter referred to as a supply ink) and the ink formed by replacing the filling liquid (hereinafter referred to as a replaced-ink), printing quality may possibly suffer from the effect of the color difference.

Accordingly, in this embodiment, the filling liquid, which was not discharged by the initial purge, is discharged from the nozzles 25 together with the ink by the initial flushing performed after the initial purge. By doing so, the color difference between the supply ink and the replaced-ink becomes small and it is possible to ensure printing quality sufficiently.

The color difference between the supply ink and the replaced-ink varies based on the color of each of the supply inks and/or the color of each of the replaced-inks. Here, a case in which the inks are uniformly jetted from all of the nozzles 25 during the initial flushing is taken into consideration. In this case, in order to ensure the sufficient printing quality, it is necessary to jet the inks, from all of the nozzles 25, in the same amount as that of the inks jetted from the nozzles 25 from which the supply ink having the greatest color difference with respect to the replaced-ink is jetted. Therefore, the inks are excessively jetted from the nozzles 25 from which the supply inks other than the ink having the greatest color difference with respect to the replaced-ink are jetted. As a result, ink consumption during the initial flushing has to be increased.

In view of the above, in this embodiment, during the initial flushing, a jetting amount of ink is made to be small in the nozzles 25 from which the supply ink having a small color difference with respect to the replaced-ink is jetted, as compared with other nozzles 25 from which the supply ink having a great color difference with respect to the replaced-ink is jetted (the jetting amount of ink during the initial flushing is made to vary according to the color difference described above). In particular, the initial flushing is performed by jetting inks a plurality of times from each of the nozzles 25. It is allowable that the jetting of ink is performed a smaller number of times, during the initial flushing, in the nozzles 25, from which the supply ink having a smaller color difference with respect to the replaced-ink is jetted. Alternatively, it is also allowable that, during the initial flushing, a volume of ink-jetted in a single ink-jet, from the nozzles 25 from which the supply ink having the small color difference with respect to the replaced-ink is jetted, is made to be small, as compared with other nozzles 25 from which the supply ink having the great color difference with respect to the replaced-ink is jetted. Or, during the initial flushing, the volume of ink jetted in the single ink jet, from the nozzles 25 from which the supply ink having the smaller color difference with respect to the replaced-ink is jetted, is made to be smaller. By doing so, the inks are not jetted from the nozzles 25 excessively during the initial flushing, and it is possible to suppress the ink consumption during the initial flushing as much as possible.

Next, an example of the present teaching will be explained. In this example, the L*a*b color system recommended by Commission Internationale de l'Éclairage (International Commission on Illumination, CIE) is used as an index of color difference. The parameter L* indicates lightness. In the parameter a*, larger values (positive value) indicate red/magenta and smaller values (negative value) indicate green. In the parameter b*, larger values (positive value) indicate yellow and smaller values (negative value) indicate blue. TABLE 1 shows, with respect to the colors of the supply inks (Yellow (Y), Magenta (M), Cyan (C)) and the replaced-inks, parameters a*, b* in the L*a*b color system and color differences ΔE between the supply inks and the replaced-inks.

TABLE 1

| FILLING LIQUID | INK | L* | a* | b* | ΔE |
|---|---|---|---|---|---|
| — | Y | 92.39 | −1.07 | 78.76 | — |
| | M | 57.84 | 62.80 | −6.99 | — |
| | C | 59.06 | −21.54 | −48.83 | — |
| M | Y | 92.44 | −1.00 | 76.60 | 2.16 |
| | M | 58.81 | 62.48 | −7.75 | 1.27 |
| | C | 59.56 | −21.64 | −48.91 | 0.51 |
| Y | Y | 92.46 | −1.70 | 77.17 | 1.71 |
| | M | 58.69 | 62.26 | −7.81 | 1.30 |
| | C | 59.51 | −21.89 | −48.56 | 0.63 |
| Bk + Y | Y | 92.27 | −1.13 | 78.72 | 0.14 |
| | M | 58.31 | 61.54 | −4.17 | 3.12 |
| | C | 60.63 | −22.43 | −44.35 | 4.83 |

The parameters L*, a*, b* in TABLE 1 were obtained by analyzing the colors of the inks jetted from the ink-jet head 3 onto a white recording paper P. Note that values shown in the upper rows of TABLE 1, where the symbol '*' is shown in the column of "FILLING LIQUID" indicate the parameters L*, a*, b* of the supply inks. Further, the color difference ΔE is defined as follows. Here, $L_0$*, $a_0$*, $b_0$* shown in the following expression indicate L*, a*, b* of the filling liquid, respectively.

$$\Delta E=\sqrt{(L^*-L_0^*)^2+(a^*-a_0^*)^2+(b^*-b_0^*)^2} \quad \text{EXPRESSION 1}$$

In this example, (a) filling liquid containing the color material of magenta, (b) filling liquid containing the color material of yellow, and (c) filling liquid containing color materials of black and yellow were used as the filling liquid. In the columns of "FILLING LIQUID" in TABLE 1, "M" expresses that the aforementioned (a) was used, "Y" expresses that the aforementioned (B) was used, and "Bk+Y" expresses that the aforementioned (C) was used. Density of each color material in each filling liquid was 0.4%.

As can be seen from TABLE 1, when the filling liquid containing the color material of magenta was used, the smallest color difference ΔE between the supply ink and the replaced-ink was obtained when the cyan ink was used as the supply ink. The color difference ΔE increased in order of magenta, yellow. Such a result was also obtained similarly when the filling liquid containing the color material of yellow was used. Further, when the filling liquid containing the color materials of black and yellow was used, the smallest color difference ΔE between the supply ink and the replaced-ink was obtained when the yellow ink was used as the supply ink. The color difference ΔE increased in order of magenta, cyan.

In this embodiment, the values of color difference ΔE as shown in TABLE 1 are stored in RAM etc., of the controller 50. During the initial flushing, with reference to the stored values of the color difference ΔE, the ink is made to be jetted in the smaller amount from the nozzles 25, from which the supply ink having the smaller color difference ΔE with respect to the replaced-ink is jetted.

For example, when the filling liquid containing the color material of yellow is used, it may be assumed that the color difference ΔE would be smallest in the yellow ink, which has the color closest to the color of the color material (yellow). However, as shown in TABLE 1, the smallest color difference ΔE was obtained when the cyan ink was used as the supply ink, and the color difference ΔE was largest when the yellow ink was used as the supply ink.

Considering the results described above, in general, it has been known that when each of the supply inks of yellow, cyan, and magenta is mixed with the tilling liquid containing the color material of any of yellow, cyan, or magenta color, the replaced-ink in which the supply ink is mixed with the filling liquid has a color darker than that of the ink in which the supply ink is not mixed with the filling liquid (subtractive color mixing). Therefore, as the color of the ink in which the supply ink is not mixed with the filling liquid is lighter, the color change of ink, which is caused when the supply ink is mixed with the filling liquid, is greater.

Accordingly, it may be considered as follows. That is, when the filling liquid containing the color material of yellow is used, the smallest color difference of is obtained when the cyan ink having the darkest color is used as the supply ink. On the contrary, the color difference of is largest when the yellow ink having the lightest color is used as the supply ink. It is affirmed that such a result is also obtained similarly when the filling liquid containing the color material of magenta or cyan is used.

Further, as described above, when the yellow ink is used as the supply ink, the color change of the ink, which is caused when the supply ink is mixed with the filling liquid containing the color material, is largest. Thus, from a viewpoint of decreasing the color change of the supply ink of each of the three colors, the color change being caused when each of the inks is mixed with the filling liquid, it is preferable to use the filling liquid containing the color material of yellow, which is closest to the yellow ink.

Further, in order to sufficiently decrease the effect on printing quality, it is preferable that the value of color difference of is, for example, less than 2. As shown in TABLE 1, when the filling liquid containing the color material of yellow is used, the values of the color difference of are less than 2 with respect to all of the colors of the supply inks, at the point in time at which the initial purge is completed. Therefore, during the initial flushing, it is not necessary to jet a large amount of ink from the nozzles 25 from which the ink of any color is jetted, and it is possible to reduce the ink consumption during the initial flushing. Also from this result, it is appreciated that the filling liquid containing the color material of yellow is preferably used.

TABLE 1 shows parameters L*, a*, b* and the color differences of for the supply inks under the condition that the supply inks include only color inks (yellow, cyan, magenta). In a case that the supply ink is the black ink, the color change, which is caused when the supply ink is mixed with the filling liquid containing the color material, is considered to be small as compared with each color ink. The color difference ΔE of the supply ink of black with respect to the replaced-ink is sufficiently small as compared with the color differences ΔE of the supply inks of Yellow, cyan, and magenta with respect to the replaced-inks. Therefore, as compared with the ink amount jetted from the nozzles 25, from which the ink jetted in the smallest jetting amount among the color inks is jetted, an even smaller amount of ink is jetted, during the initial flushing, from the nozzles 25 from which the black ink is jetted.

When the filling liquid containing the color materials of black and yellow was used, as is clear by comparison with the case in which the filling liquid containing the color material of yellow was used, the color differences ΔE in the magenta ink and the cyan ink were especially large. In other wards, fluctuation of the color difference of due to difference in color of the supply ink is increased. In such a case, even if inks are respectively jetted, during the initial flushing, in considerably large amounts from the nozzles 25, from which the magenta ink and the cyan ink are respectively jetted, the color difference ΔE of between each supply ink and the replaced-ink is hardly reduced, and the fluctuation of the color difference ΔE due to the difference in color of the supply ink remains significant. Thus, the effect on the printing quality is increased.

Therefore, it is preferable that the color material contained in the filling liquid is the dye which is the color material of each of the color inks, other than the pigment which is the color material of the black ink.

Next, modified embodiments in which various modifications are made in the embodiment will be described below. The same reference numerals are assigned to components having the same structure as in the embodiment, and the description of such components is appropriately omitted.

In the embodiment described above, the ink-jet head 3 is capable of jetting the black ink and color inks. However, it is allowable that the ink-jet head 3 is capable of jetting color inks only.

In the embodiment described above, the color material of the filling liquid is the same as the color material (dye) which is contained in one of color supply inks. However, the present teaching is not limited thereto. The color material of the filling liquid may be the pigment which is the color material of the black supply ink. Further, the color material of the filling liquid may be a color material other than the dye which is the color material of each of the color inks and the pigment which is the color material of the black ink. For example, it is allowable to use, as the color material of the filling liquid, a color material having a color different from that of the color material contained in each of color inks of cyan, magenta, and yellow, each of color inks being used as the supply ink. Further, in the embodiment described above, one type of filling liquid is used commonly to all of the supply inks. However, the present teaching is not limited thereto. For example, it is allowable to use a plurality of types of filling liquids containing color materials, which respectively correspond to colors of the supply inks and are different from each other. In this case, it is preferable that the suction purge is performed for each of the colors, for example, by dividing the interior of the suction cap 6 for each of the nozzle arrays corresponding to each of the colors.

Further, in the embodiment described above, during the initial flushing, the ink is made to be jetted in the smaller amount from the nozzles 25, from which the supply ink having the smaller color difference with respect to the replaced-ink is jetted. However, the present teaching is not limited thereto. For example, during the initial flushing, it is allowable that: the supply ink having a color whose color difference ΔE is not more than a certain threshold value is jetted from the nozzles 25 in a first constant amount; and that the supply ink having a color whose color difference ΔE exceeds the certain threshold value is jetted from the nozzles 25 in a second constant amount, which is smaller than the first constant amount. Further, the jetting amount of ink during the initial flushing from the nozzles 25 may vary for each of the colors according to the color difference between the supply ink and the replaced-ink.

In the embodiment described above, the jetting amount of ink during the initial flushing is adjusted depending on the magnitude of the color difference between the supply ink and the replaced-ink. However, the present teaching is not limited thereto. For example, in addition to the initial flushing, or instead of the initial flushing, the discharge amount of ink during the initial purge may be adjusted depending on the magnitude of the color difference between the supply ink and the replaced-ink. As described above, the replaced-ink is formed such that a part of the filling liquid in the ink-jet head 3 and the ink tube 12 is replaced with the supply ink by performing the initial purge. For example, in a case that there is a large color difference between the supply ink and the replaced-ink, the discharge amount of ink during the initial purge is allowed to be increased as compared with the case in which the color difference is small. By doing so, it is possible to reduce the color difference between the supply ink and the replaced-ink upon completion of the initial purge and to suppress fluctuation of the color difference due to the difference in color of the supply ink. Accordingly, it is possible to reduce any effect of the filling liquid on the printing quality.

Further in the embodiment described above, in the initial purge, the ink in the ink-jet head 3 is discharged by the suction purge in which the ink in the ink-jet head 3 is sucked from the nozzles 25 by using the suction pump 8. However, the ink in the ink-jet head 3 can be discharged from the nozzles 25 by a so-called pressurized purge (push purge) in which pressure is applied from a side of the sub tank 4 to the ink in the ink-jet head 3.

In the above description, the explanations are made about the examples in which the present teaching is applied to a printer provided with a so-called serial type ink-jet head which jets inks while moving, together with a carriage, in a scanning direction. However, the present teaching is not limited thereto. For example, it is possible to apply the present invention to a printer provided with a so-called line head which is fixed to the printer and extends over the entire length of the recording paper P in the width direction.

What is claimed is:

1. An ink-jet printer which jets a plurality of color inks, comprising:

an ink supply source which supplies the plurality of color inks;

an ink-jet head which is connected to the ink supply source and in which a plurality of nozzles are formed, the plurality of nozzles forming a plurality of nozzle groups from which the plurality of color inks are jetted respectively;

a maintenance mechanism which performs a discharge operation of the ink-jet head so that a liquid in the ink-jet head is discharged from the plurality of nozzles;

a controller which controls the ink-jet head and the maintenance mechanism;

a filling liquid which is filled in the ink-jet head before the ink-jet printer is used for the first time, which is different from the plurality of color inks, and which contains a color material of a color; and a first memory storing information regarding a color difference between one of the plurality of color inks supplied from the ink supply source to the ink-jet head and a replaced-ink which is formed by replacing a part of the filling liquid with the one of the plurality of color inks supplied into the ink-jet head and which is formed by mixing a residual part of the filling liquid that is not replaced and the one of the plurality of color inks;

wherein, before the ink-jet printer is used for the first time, the controller controls the maintenance mechanism and the ink-jet head to perform an initial discharge operation including one of an initial purge and an initial flushing so that an amount of a liquid discharged from the ink-jet head during the initial discharge operation is adjusted based on the information regarding the color difference read from the first memory.

2. The ink-jet printer according to claim 1;

wherein the controller is configured to control the maintenance mechanism so that the initial purge, in which the filling liquid in the ink-jet head is discharged and the filling liquid in the ink-jet head is replaced with the one of the plurality of color inks supplied from the ink supply source, is performed; and that after performing the initial purge, the initial flushing is performed in which the amount of the liquid discharged from the nozzles is adjusted based on the color difference.

3. The ink-jet printer according to claim 2;

wherein the controller controls the ink-jet head so that as the color difference is smaller, a jetting amount of the liquid during the initial flushing is smaller.

4. The ink-jet printer according to claim 3;

wherein the plurality of color inks include a yellow ink, a magenta ink, and a cyan ink;

wherein the plurality of nozzles include a yellow nozzle for jetting the yellow ink, a magenta nozzle for jetting the magenta ink, and a cyan nozzle for jetting the cyan ink;

wherein the filling liquid includes only a yellow color material; and wherein the controller controls the ink-jet head so that, during the initial flushing, a jetting amount of the liquid jetted from the cyan nozzle is made to be smaller than a jetting amount of the liquid jetted from the yellow nozzle and a jetting amount of the liquid jetted from the magenta nozzle.

5. The ink-jet printer according to claim 2;

wherein the plurality of color inks include a black ink containing a pigment as the color material and a color ink containing a dye as the color material; and wherein the color material of the filling liquid is the dye which is the same as the color material of the color ink.

6. The ink-jet printer according to claim 1;

wherein the filling liquid is made such that the color difference is less than 2 with respect to all of the plurality of color inks.

7. The ink-jet printer according to claim 1;

wherein the filling liquid is common to the plurality of color inks; and the maintenance mechanism includes a suction cap which covers the plurality of nozzle groups, a moving mechanism which moves the suction cap so that the suction cap makes contact with the ink-jet head, and a suction pump which is communicated with the suction cap.

8. The ink-jet printer according to claim 1, further comprising:

a memory which stores information of a discharge amount of the liquid that is set based on an experimental data for the color difference;

wherein the controller controls the maintenance mechanism and the ink-jet head to perform the initial discharge operation based on the information stored in the memory.

9. A method for replacing a filling liquid filled in an ink-jet head by a plurality of color inks, comprising the steps of:

performing an initial purge in which the filling liquid in the ink-jet head is replaced by one of the plurality of color inks supplied from an ink supply source by discharging a liquid containing the filling liquid and the one of the plurality of color inks from the ink-jet head, wherein:

the ink-jet head is connected to the ink supply source supplying the plurality of color inks, and a plurality of nozzles is formed therein;

the plurality of nozzles forms a plurality of nozzle groups from which the plurality of color inks are jetted respectively;

the filling liquid, which is different from the plurality of color inks and which contains a color material of a certain color, is filled in the ink-jet head in a state before an ink-jet printer is used for the first time; and a first memory stores information regarding a color difference between one of the plurality of color inks supplied from the ink supply source to the ink-jet head and a replaced-ink which is formed by replacing a part of the filling liquid with the one of the plurality of color inks supplied into the ink-jet head and which is formed by mixing a residual part of the filling liquid that is not replaced and the one of the plurality of color inks performing an initial flushing in which the liquid containing the filling liquid and the one of the plurality of color inks is discharged from the plurality of nozzles after performing the initial purge;

wherein, during at least one of the initial purge and initial flushing, an amount of the liquid discharged from the ink-jet head is adjusted based on the information regarding the color difference read from the first memory.

10. The method according to claim 9;

wherein, during the initial flushing, an amount of the liquid discharged from the ink-jet head is adjusted based on the color difference.

* * * * *